US011801681B2

(12) United States Patent
Luke et al.

(10) Patent No.: US 11,801,681 B2
(45) Date of Patent: Oct. 31, 2023

(54) SEVERABLE DISPENSABLE SUBSTANCE CONTAINERS

(71) Applicant: HEWLETT-PACKARD DEVELOPMENT COMPANY, L.P., Spring, TX (US)

(72) Inventors: Jeffrey H. Luke, Boise, ID (US); Mathew Lavigne, Boise, ID (US); Sean Daniel FitzGerald, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 530 days.

(21) Appl. No.: 17/261,064

(22) PCT Filed: Nov. 15, 2018

(86) PCT No.: PCT/US2018/061215
§ 371 (c)(1),
(2) Date: Jan. 18, 2021

(87) PCT Pub. No.: WO2020/101684
PCT Pub. Date: May 22, 2020

(65) Prior Publication Data

US 2021/0309014 A1 Oct. 7, 2021

(51) Int. Cl.
*B05C 17/00* (2006.01)
*B41J 2/175* (2006.01)
(Continued)

(52) U.S. Cl.
CPC ..... *B41J 2/17506* (2013.01); *B05C 17/00506* (2013.01); *B05C 17/0106* (2013.01);
(Continued)

(58) Field of Classification Search
CPC ..... B05C 17/005006; B05C 17/0106; A61M 2005/5006; B41J 2/17506; B41J 2/17509;
(Continued)

(56) References Cited

U.S. PATENT DOCUMENTS 3,951,146 A * 4/1976 Chiquiar-Arias ..... A61M 5/178 604/110
4,639,250 A * 1/1987 Rycroft ..... A61M 5/346 604/206

(Continued)

FOREIGN PATENT DOCUMENTS

| | | |
|---|---|---|
| EP | 0878309 | 11/1998 |
| EP | 2604434 | 6/2013 |
| WO | WO-0226502 | 4/2002 |

OTHER PUBLICATIONS

Chainsaw Journal, Boss Log Splitter Buying Guide—Which Model is Right for You? Splitting Firewood, Oct. 30, 2016 (52 pages).

(Continued)

*Primary Examiner* — Frederick C Nicolas
*Assistant Examiner* — Randall A Gruby
(74) *Attorney, Agent, or Firm* — Foley & Lardner LLP

(57) ABSTRACT

A dispensable substance container may include a printing substance dispensing nozzle including a first material. The dispensable substance container an elongate body, including a wall, including a second material encompassing a cavity to contain a dispensable substance, and an attachment portion to attach the elongate body to the printing substance dispensing nozzle; and a structurally compromised portion of the elongate body extending along a length of the elongate body, wherein the elongate body and the attachment portion are to be severed along the structurally compromised portion by a pushrod moveable through the cavity to expel the dispensable substance out the dispensing nozzle.

15 Claims, 6 Drawing Sheets

(51) Int. Cl.
*B41F 31/02* (2006.01)
*B05C 17/005* (2006.01)
*B05C 17/01* (2006.01)

(52) U.S. Cl.
CPC ..... *B41F 31/02* (2013.01); *B41J 2/17509* (2013.01); *B41J 2/17513* (2013.01); *B41J 2/17523* (2013.01); *B41J 2/17553* (2013.01)

(58) Field of Classification Search
CPC ..... B41J 2/17513; B41J 2/17523; B41J 2/17553; B41F 31/02
USPC ..... 604/110, 164.05, 187–243
See application file for complete search history.

(56) References Cited

U.S. PATENT DOCUMENTS 5,104,388 A * 4/1992 Quackenbush ... A61M 25/0668 604/164.05
5,489,976 A 2/1996 Ichikawa
5,706,870 A * 1/1998 Maerzke ..... B41J 2/17506 141/2
5,858,000 A * 1/1999 Novacek ..... A61L 2/28 604/110
6,344,031 B1 * 2/2002 Novacek ..... A61M 5/3135 604/110
7,060,049 B2 6/2006 Trombley
7,789,855 B2 9/2010 Liu
8,562,571 B2 * 10/2013 Mudd ..... A61M 5/3158 604/218
2004/0186428 A1 * 9/2004 Ray ..... A61M 5/50 604/110
2006/0041231 A1 2/2006 Pressly
2007/0244444 A1 * 10/2007 Guelker ..... A61D 7/00 604/207
2009/0270814 A1 * 10/2009 Masi ..... A61M 5/34 604/190
2014/0228804 A1 8/2014 Castillo
2015/0038918 A1 2/2015 Mudd
2020/0399046 A1 * 12/2020 Luke ..... B05B 11/02

OTHER PUBLICATIONS what-when-how.com, In Depth Tutorials and Information, Administration of Injectable Medications (Pharmacology and Administration of Medications) (Nursing) Part 1 downloaded Jun. 14, 2018 (11 pages).

* cited by examiner

SEVERABLE DISPENSABLE SUBSTANCE CONTAINERS

BACKGROUND

Containers may be utilized to contain, store, and/or transport substances. Containers may contain substances that may be dispensed from the containers. For example, some containers may be utilized to dispense the dispensable substances into other containers. Containers that may be utilized to dispense the dispensable substances into another container may include a structure to not only store, but to facilitate the transfer of the dispensable substance. For example, a container that may be utilized to dispense dispensable substances may include a syringe.

DETAILED DESCRIPTION

Figure 1:
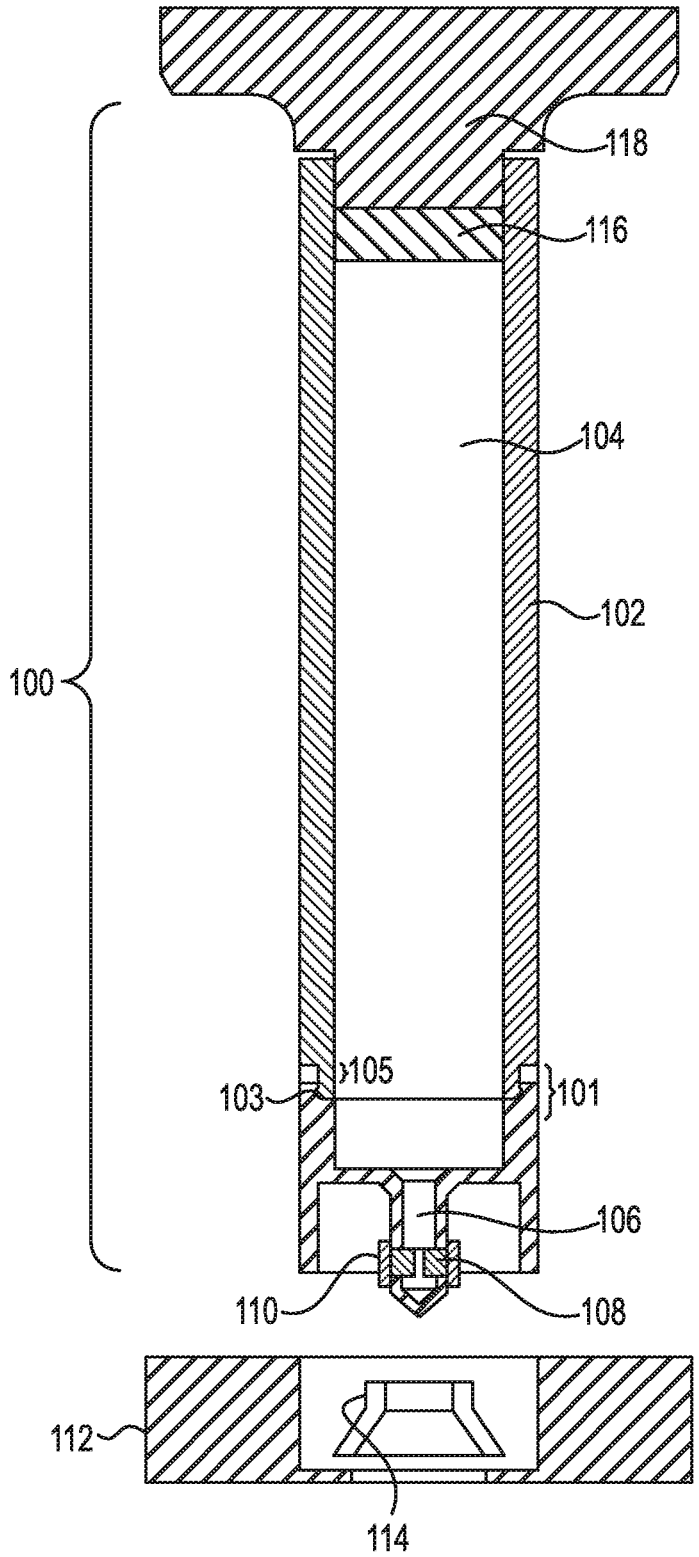
FIG. 1 illustrates a cross-sectional view of a severable dispensable substance container according to the present disclosure.

A container, such as a syringe, may include a cylindrical tube or barrel. The barrel may be utilized to store a dispensable substance. At one end of the barrel, the syringe may include a nozzle or tubing to direct flow out of the barrel. The barrel may be open at the opposing end, except for a plunger or piston that fits tightly within the barrel effectively sealing the dispensable substance off from escaping that end of the barrel.

Such a container may operate as a single-acting reciprocating pump. For example, one side of the piston may engage the dispensable substance and/or a fluid such as a gas in the barrel. The piston may be linearly pulled and/or pushed along a stroke path inside of the barrel causing the container to dispense or take in a substance through the nozzle or tubing.

In order to utilize a full volume of the barrel, the piston may be linearly pushed or pulled along a stroke path traversing the full length of an elongate barrel. As such, the piston may have a length that is at least as long as the elongate barrel to allow the piston head to read the end of the barrel proximate the nozzle, in order to fully dispense the contents thereof. Since a portion of the piston may be actuated by a user outside of the barrel, the length of the piston may exceed the length of the barrel.

As such, when the barrel of the syringe is full of a dispensable substance, the piston may be sticking out of the barrel by a length at least as long as, and in some cases longer than, the length of the barrel itself. Accordingly, the length of the syringe inclusive of the piston is at least double the barrel length when the barrel is full of a dispensable substance. Additional length may make shipping or otherwise transporting the syringe more difficult. For example, a long syringe may be more awkward and/or costly to transport. A long syringe may be more prone to damage than a shorter one on account of the additional length being exposed. Additionally, a long syringe may not fit into small spaces with insufficient clearance for the length. In some examples, a syringe with a shorter barrel and correspondingly dimensioned piston may be utilized to fit into small spaces. However, the volume of the syringe may be reduced when its length is reduced. As such, length and/or volume restrictions associated with utilizing syringe-like containers in confined spaces may render such containers unsuitable for particular applications.

Additionally, barrels, pushrods, seals, and/or nozzles may be constructed of a same material and/or of materials that are recyclable in combination. That is, constituent components of a syringe may be made from a single material or materials that are able to be disposed and/or recycled together. As such, the constituent components of a syringe may be made of a material or materials with same or similar mechanical, physical, chemical, and/or manufacturing properties. However, the particular functions of the components, the manufacturing process of the components, and/or the forces to which each component is subjected may differ such that utilizing the same material for all the components introduces structural deficiencies and/or inflated costs to manufacture and ship. For example, components of the syringe may be over-engineered in the sense that they are constructed from a material that is heavier, stiffer, and more expensive to manufacture than its function or expected force load may necessitate in order to carry through the use of a same material utilized in a different component of the same syringe that has a higher expected force load.

However, utilizing a syringe with the constituent components constructed of mixed materials, such as materials that are separately recyclable, may involve disassembly of the syringe after its contents are dispensed. That is, after the contents of the syringe are dispensed the constituent components may be joined to the extent that disassembly, such as reverse assembly or reverse actuation of the pushrod may be involved. For example, once a dispensing stroke of a syringe is completed a pushrod may be inserted to a deepest point (e.g., closest to the nozzle) of a barrel. If the pushrod and the barrel are separately recyclable materials, the pushrod may be withdrawn from the barrel of the syringe by utilizing a reverse stroke. However, such a reverse stroke in a sealed body of the barrel will involve the application of enough force to overcome the suction force associated with a reduced diameter of a nozzle relative to a diameter of a barrel and/or the resistance resulting from creation of negative pressure within the barrel body. Additionally, when the pushrod reaches the end of the reversed stroke and is being removed from the barrel body a sudden reduction in the force involved in moving the pushrod may result from a rapid normalization of pressure inside the barrel. As a result of a lag in the ability of the user to modulate the force they are applying to the pushrod accordingly, the pushrod may 'pop' out of the barrel causing an inadvertent spill or splatter of residual contents of the syringe.

The effort or physical strength involved in disassembly, the potential for a mess resulting from disassembly, and/or a risk of damage to an environment and/or a user resulting from disassembly of the syringe may result in a user being less likely to engage in the disassembly to separate the constituent components of the syringe after dispensing the contents thereof. As such, improper disposal and decreased recycling of syringe products, which may include plastics that are non-biodegradable and therefore critical to recycle, may result from the use of mixed material syringes involving disassembly after use. Further, the inclusion of fully assembled mixed material syringes within a recycling bin may result in an increased cost of and/or prevention of the recycling of other contents of the recycling bin.

In contrast, examples of the present disclosure may include a dispensable substance container including a printing substance dispensing nozzle comprising a first material and an elongate body including a wall, comprising a second material encompassing a cavity to contain a dispensable substance. The elongate body may include an attachment portion to attach the elongate body to the printing substance dispensing nozzle and a structurally compromised portion of the elongate body extending along a length of the elongate body, wherein the elongate body and the attachment portion are to be severed along the structurally compromised portion by a pushrod moveable through the cavity to expel the dispensable substance out the dispensing nozzle. As such, examples of the present disclosure may include a dispensable substance container with constituent components that may be constructed from different materials that, rather than relying on disassembly to separate the joined components after dispensing the substance, is severed into its separately recyclable constituent components by the movement of the pushrod through the elongate body during dispensing of its contents.

FIG. 1 illustrates a cross-sectional view of a dispensable substance container 100 according to the present disclosure. The dispensable substance container 100 may include an elongate body 102. The elongate body 102 may include a wall that defines and/or encompasses a cavity 104. The cavity 104 may be filled with, refilled with, and/or contain a dispensable substance.

The elongate body 102 may include a wall that may have any geometry and/or define a cavity 104 of any geometry. In an example, the elongate body 102 may be a barrel or tube that is cylindrically shaped. In some examples the cavity 104 may be cylindrically shaped. In other examples, the elongate body 102 and/or the cavity 104 may have square, oval, triangular, etc. geometries. The elongate body 102 may include a body that is longer than it is wide.

The elongate body 102 may include a wall comprising a first material. The wall of the elongate body 102 may comprise a first material having a first set of mechanical, physical, chemical, and/or manufacturing properties. For example, the wall of the elongate body 102 may be made of up of a pulp fiber such as a cardboard. The pulp fiber wall of the elongate body 102 may be able to be printed on upon an exterior face of the wall. The interior face of the wall that contacts the contents of the cavity 104 may be coated with and/or otherwise include a barrier material. For example, the interior face of the wall may include a moisture barrier and/or a friction coefficient reducing coating such as a wax or polymer coating.

The dispensable substance that may be contained within the cavity 104 may be a solid, a liquid, and/or a gas. The dispensable substance may be a substance that may be contained in and/or expelled from the elongate body 102. That is, the dispensable substance may flow into, out of, and/or through the cavity 104 formed by the wall of the elongate body 102 under external pressure. For example, the dispensable substance may be a printing substance. A printing substance may include a liquid printing ink, a toner powder, a three-dimensional printing substance, etc.

The dispensable substance container 100 may be sealed from the external environment. For example, the elongate body 102 and its contents may be sealed from the external environment at a first end. For example, a first end of the elongate body 102 may include a dispensable substance dispensing nozzle 106. The dispensing nozzle 106 may be attached to the first end of the elongate body 102.

For example, the elongate body 102 and/or dispensing nozzle 106 may include an attachment portion 101. The attachment portion 101 may include a portion of the elongate body 102 and/or a portion of the dispensing nozzle 106 that form an attachment point between the elongate body 102 and dispensing nozzle 106. The attachment portion 101 may fix the elongate body 102 and dispensing nozzle 106 together. For example, the attachment portion 101 may prevent removal of the elongate body 102 from the dispensing nozzle 106 while the attachment portion 101 is intact. That is, removal of the elongate body 102 from the dispensing nozzle 106 while the attachment portion 101 is intact may not be accomplished by a disassembly operation but may be achievable with application of a force in an amount to cause mechanical failure and/or destruction of the elongate body 102, the dispensing nozzle 106, and/or the attachment portion 101.

The attachment portion 101 may include a portion of the elongate body 102 and/or a portion of the dispensing nozzle 106 having complementary geometries that allow the portion of the elongate body 102 and/or a portion of the dispensing nozzle 106 to interface against each other. The attachment portion 101 may include these interfaces. For example, the attachment portion 101 may include interfaces of the elongate body 102 and/or the dispensing nozzle 106 may form an attachment utilizing an adhesive and/or friction fit to fix the elongate body 102 and/or the dispensing nozzle 106 to one another while the attachment portion 101 is in place. In some examples, the attachment point 101 may alternatively or additionally include interlocking interfaces of a portion of the elongate body 102 and/or a portion of the dispensing nozzle 106, For example, the attachment point 101 may include an extension or lip 103 extending off a surface, such as, for example, an exterior surface, of the wall of the elongate body 102 and/or an extension or lip 105 extending off a surface, such as, for example, an interior surface, of the dispensing nozzle 106. The lip 103 and/or the lip 105 may interlock with one another. For example, a lip 105 may act as a retention ledge or stop that prevents the lip 103 from moving past it and disengaging the elongate body 102 from the dispensing nozzle 106.

The dispensing nozzle 106 may include a wall shaped to control the direction and/or characteristics of the flow of the dispensable substance from the dispensable substance container 100, The dispensing nozzle 106 may comprise a second material. The second material may be a different material than the first material. For example, the second material may have a second set of mechanical, physical, chemical, and/or manufacturing properties that are different from the first set of mechanical, physical, chemical, and/or manufacturing properties of the first material. In some examples, the first and the second materials may be separately or individually recyclable. In some examples, the first and the second materials may involve different recycling operations that may not be compatible. In some examples, the first and second materials may have different recyclability statuses, such as recyclable and non-recyclable. The first and second materials may have different costs and/or methods of manufacture. The first and second material may be materials that are to be separated prior to recycling and/or disposing.

For example, the dispensing nozzle 106 may be made of a second material such as a plastic material. The dispensing nozzle 106 may be made of a plastic that is relatively soft and flexible to adapt to various insertion techniques and orientation that may be utilized in aligning the dispensing nozzle 106 for dispensing involved in dispensing the dispensable substance.

In some examples, the walls of the dispensing nozzle 106 may define a cavity that has a smaller volume and/or diameter than the cavity of the elongate body 102. In some examples, the walls of the dispensing nozzle 106 may be tapered.

The dispensing nozzle 106 may include an opening 108. The opening 108 may be one of a plurality of openings in the dispensing nozzle 106. The opening 108 may include an opening into a cavity of the dispensing nozzle 106. Since the dispensing nozzle 108 may be in fluid communication with the elongate body 102, the opening 108 may be an opening where a dispensable substance expelled from the elongate body 102 is dispensed.

In some examples, the dispensing nozzle 106 may include a sleeve 110. The sleeve 110 may include a body encompassing the body of the dispensing nozzle 106 and obstructing the opening 108 when in place. In some examples, the sleeve 110 may be attached to the dispensing needle via a frangible attachment and/or itself be frangible. When the dispensable substance container 100 is joined with a dispensable substance receiving container 112, a protrusion 114 from the dispensable substance receiving container 112 may break the sleeve 110 free from the dispensing nozzle 106 and translate the sleeve 110 away from the opening 108 allowing the opening 108 to be utilized to dispense the dispensable substance.

The dispensable substance receiving container 112 may include a container for receiving and/or storing the dispensable substance that is dispensed from the dispensable substance container 100. In some examples, the dispensable substance container 100 and the dispensable substance receiving container 112 may include specialized complementary structures that facilitate the mating of the two together and introduce fluid communication between the two. That is, the dispensable substance container 100 and/or the dispensable substance receiving container 112 may include complementary mating mechanisms which slide together in an interlocking fashion to mate the two together by aligning the dispensing nozzle with an opening in a dispensing substance receiving container 112.

In some examples, the dispensable substance receiving container 112 may include a printing substance reservoir or cartridge. For example, the dispensable substance receiving container 112 may be a portion of a printing device that serves as a reservoir for the dispensable printing substance until a time when the dispensable printing substance is to be utilized for a printing operation of the printing device.

The elongate body 102 and its contents may also be sealed from the external environment at a second end. For example, a second end of the elongate body 102 may include a sealing material 116. The sealing material 116 may include a gasket, such as a rubber or plastic gasket. The sealing material 116 may be utilized as a plunger or piston head may be utilized in a syringe. For example, the sealing material 116 may seat tightly within the elongate body 102 engage the walls of the elongate body 102. The sealing material 116 may be moveable along an entire length of the elongate body 102. For example, the sealing material 116 may engage the walls of the elongate body 102 along the entire inner circumference of such walls such that the sealing material may wipe the inner surface walls of the elongate body 102 and advance a dispensable substance through the elongate body 102 without allowing the dispensable substance to slip past the sealing material 116 as the sealing material 116 is advanced through the elongate body 102.

As described above, the sealing material 116 may be moveable throughout the elongate body 102 to advance a dispensable substance within the elongate body 102 through the elongate body 102, through the dispensing nozzle 106, and out of the opening 108. While gravity may assist this movement, additional force loads may be transferred to the dispensable substance in the cavity 104 of the elongate body 102 via the sealing material 116. However, this may mean that a force load may be applied to the sealing material 116. In some examples, the force load may be introduced by a user of the dispensable substance container 100. The force load may be a force load of a magnitude to overcome a pressure within the cavity 104 and advance the dispensable substance and/or the sealing material 116.

A force load may be introduced to the dispensable substance in the cavity 104 of the elongate body 102 and/or the sealing material 116 by a pushrod 118. A pushrod 118 may be a separate component from and/or integrated with the elongate body 102. The pushrod 118 may be a separate component from and/or integrated with the sealing material 116. The pushrod 118 may be depressed by a user utilize a force load. The pushrod 118 may transfer the force load 118 to the sealing material 116 and/or the dispensable material within the cavity 104 by advancing the sealing material 116 through the cavity 104 of the elongate body 102.

As such, the pushrod 118 may be moveable through the cavity 104 of the elongate body 102, For example, a portion of the pushrod 118 may be moveable within and through the cavity along the length of the elongate body 102 between a first end, distal from the dispensing nozzle 106, of the elongate body 102 and a second end, proximate the dispensing nozzle 106, of an elongate body 102. The movement of the portion of the pushrod 118 through the cavity 104 of the elongate body 102 may expel dispensable substance within the cavity 104 of the elongate body 102 out of the dispensing nozzle 106. For example, the movement of the portion of the pushrod 118 through the cavity 104 of the elongate body 102 may advance the sealing material 116 through the cavity 104 of the elongate body 102, thereby dispensable substance within the cavity 104 of the elongate body 102 out of the dispensing nozzle 106.

The pushrod 118 may comprise a third material. The third material may be a different material than the first material and the second material. For example, the second third material may have a third set of mechanical, physical, chemical, and/or manufacturing properties that are different from the first set and/or second set of mechanical, physical, chemical, and/or manufacturing properties of the first and second materials, respectively. In some examples, the first, second, and third materials may be separately or individually recyclable. In some examples, the first, second, and third materials may involve different recycling operations that may not be compatible. In some examples, the first, second, and third materials may have different recyclability statuses, such as recyclable and non-recyclable. The first, second, and third materials may have different costs and/or methods of manufacture. The first, second, and third materials may be materials that are to be separated prior to recycling and/or disposing.

For example, the pushrod 118 may be made of a second material such as a plastic material that is different from the plastic material of the dispensing nozzle 106. For example, the pushrod 118 may be made of a plastic that is relatively hard and inflexible to transfer user applied force to the contents of the contents of the cavity 104 of the elongate body 102 without loss due to flex of the pushrod 118 and to sever the structurally compromised portion of the elongate body 102 and the attachment portion 101, as described in greater detail below.

Unlike other syringes, the pushrod 118 of examples of the present disclosure may have a length that is less than the length of the elongate body 102 and/or the cavity 104. In some examples, the pushrod 118 may have a length that is less than half the length of the elongate body 102 and/or the cavity 104. In some examples, the pushrod 118 may have a length that is less than one-quarter the length of the elongate body 102 and/or the cavity 104. In some examples, the pushrod 118 may have a length such that if it were fully advanced into the cavity 104 until a portion of the pushrod 118 (having a width greater than the width of the cavity 104 of the elongate body 102) first encountered a wall of the elongate body 102, the pushrod 118, and/or the sealing material 116 may not reach the bottom of the cavity 104 and/or the elongate body 102. Additionally, in such examples, less than the entire contents or none of the contents of the cavity 104 may be expelled from the elongate body 102.

In contrast to a reliance on a relatively longer pushrod 118 that itself as long as or longer than the length of the cavity 104 and/or the elongate body 102 to dispense the dispensable fluid from the cavity 104, examples of the present disclosure may include a structurally compromised portion of the elongate body 102. The structurally compromised portion of the elongate body may extend along a length of the elongate body 102. In some examples, the structurally compromised portion of the elongate body may extend along an entire length of the elongate body 102 up to and including through the attachment portion 101. The elongate body 102 and/or the attachment portion may be severed along the structurally compromised portion. In some examples, the structurally compromised portion of the elongate body 102 may be severed by the pushrod 118 as discussed in further detail below. In an example, a severing portion of the pushrod 118 may project outside of the cavity 104 and have a relatively higher sheer strength than the structurally compromised portion of the wall of the elongate body 102 and/or includes a geometry that will slice through the structurally compromised portion of the wall of the elongate body 102.

As used herein, the term "structurally compromised" may refer to a portion of the elongate body 102 and/or the attachment point 101 that is engineered to separate under specific force loads. In some examples, a structurally compromised portion may be structurally weakened or structurally modified relative to other portions of the elongate body 102 and/or attachment point 101.

A "structurally weakened" portion may be a portion of the elongate body 102 and/or attachment point 101 that has a reduced thickness, a reduced shear strength, different material properties, modified chemical composition, perforations, scribing, scoring, abrasions, etching, heat treatment, etc. that renders the structurally compromised portion relatively more prone or susceptible (e.g., less force load involved) to separation than adjacent portions of the elongate body 102 and/or attachment point 101.

A "structurally modified" portion may include a portion of elongate body 102 and/or attachment point 101 that includes a structural feature or architecture that may be engineered to be separated without cutting through the elongate wall 102 and/or attachment point 101. Rather, the structural feature may allow two portions to be pushed apart to achieve separation. For example, a structural modification may include an overlap of elongate body 102 walls and or walls forming the and/or attachment point 101. For example, at composite walls of the elongate body 102 and/or attachment point 101 may create an overlap localized within the structurally compromised portion. The overlap may establish and/or maintain a seal between the content within the elongate body 102 and the external environment. The structurally modified portion may be separated at the overlap.

Figure 2:
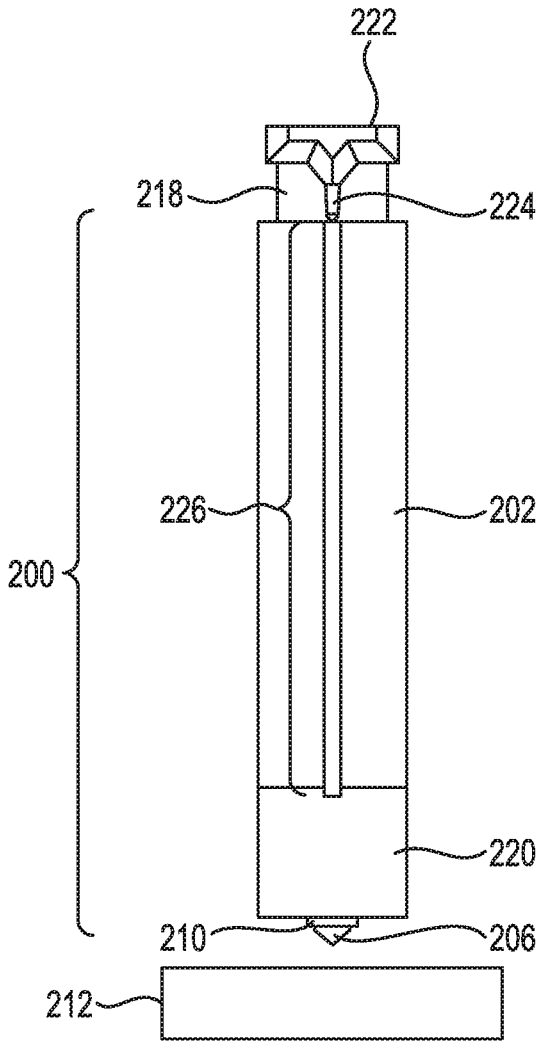
FIG. 2 illustrates a side view of a severable dispensable substance container according to the present disclosure.

In some examples, the structurally compromised portion may not be structurally weakened and/or structurally modified relative to the other portions of the elongate body 102 and/or attachment point 101. That is, the elongate body 102 and/or attachment point 101 may have a substantially uniform thickness, chemical composition, shear strength, material properties, modifications, treatment, structural characteristics, etc. across the portions of the elongate body 102 and/or attachment point 101. In such examples, the elongate body 102 and/or attachment point 101 may be constructed of a substantially uniform material that is structurally strong and/or rigid enough to provide structural integrity to the dispensable substance container during filling, storing, transporting, and dispensing a dispensable substance from the dispensable substance container, but that is soft enough to be severed by application of a force load by a first projection of a pushrod within particular force load threshold values. As such, in some examples, the entire elongate body 102 and/or attachment point 101 may be structurally compromised since it is uniformly engineered to separate under specific force loads, FIG. 2 illustrates a side view of a dispensable substance container 200 according to the present disclosure. The dispensable substance container 200 may include an elongate body 202. The elongate body 202 may be a wall that defines and/or encompasses a hollow cavity within the wall. The elongate body 202 wall may include a plurality of portions and/or layers having different characteristics and/or properties as will be described in further detail below. The elongate body 202 may be made from a first material.

The dispensable substance container 200 may include a dispensing nozzle 206 and/or a mating mechanism 220 including walls encompassing the dispensing nozzle 206 to mate with a dispensable substance receiving container 212 in an interlocking fashion to align the dispensing nozzle 206 into the dispensable substance receiving container 212. The dispensing nozzle 206 and/or the mating mechanism 220 made be made from a first material. The second material may have set of mechanical, physical, chemical, and/or manufacturing properties that are different from the first set of mechanical, physical, chemical, and/or manufacturing properties of the first material. Mating the dispensable substance container 200 with the dispensable substance receiving container 212 may cause a sleeve 210 that encompasses and obstructs openings in the dispensing nozzle 206 to break free from the dispensing nozzle and introduce fluid communication between the dispensable substance container 200 and the dispensable substance receiving container 212.

Although not visible in the exterior view provided in FIG. 2, an attachment point may exist between the elongate body 202 and the dispensing nozzle 206 and/or mating mechanism 220, For example, and wall of the elongate body 202 and/or a wall of the dispensing nozzle 206 and/or mating mechanism 220 may include portions having complementary geometries such that they form a connection at the attachment point that is structured to maintain attachment between the elongate body 202 and the dispensing nozzle 206 and/or mating mechanism 220 so long at the complementary connection portions remain intact.

A dispensable substance within the hollow cavity of the elongate body 202 may be influenced by the actuation of pushrod 218 into the cavity of the elongate body 202. The pushrod 218 may be made of a third material that has a third set of mechanical, physical, chemical, and/or manufacturing properties that are different from the first and second set of mechanical, physical, chemical, and/or manufacturing properties of the first material and second material, respectively.

As the pushrod 218, seated within the cavity of the elongate body 202, is pushed further into the cavity, the force load being applied to the pushrod 218 may be transferred to the contents of the cavity. The force load may cause the contents to advance through the cavity of the elongate body 202 and/or exit the openings on the dispensing nozzle 206.

However, as described with respect to FIG. 1, the longitudinal length of the pushrod 218 may be less than the longitudinal length of the elongate body 202 and/or the longitudinal depth of the cavity defined thereby. Since the pushrod 218 may be dimensioned to fit snuggly, but moveably, within the cavity of the elongate body 202, any projection from the body of the pushrod 218 would prevent the pushrod 218 from descending any further into the depths of the cavity within the elongate body 102 once said projection encountered a wall of the elongate body 102. As illustrated, the pushrod 218 may include a first projection 222 emanating from the central body of the pushrod 218 that will encounter the wall of the elongate body 202 as the pushrod is advanced into the cavity of the elongate body 202. The first projection 222 may include be dimensioned to a geometry and/or constructed to a shear strength that may sever the elongate body 202 and/or an attachment point between the elongate body 202 and the dispensing nozzle 210. For example, the first projection 222 may include a wedge and/or blade portion 224, although the geometry is not so limited. Specifically, the first projection 222 may include a wedge and/or blade portion 224 with a leading and/or cutting edge oriented down toward the wall of the elongate body 202. The first projection 222 and/or the wedge and/or bladed portion 224 may emanate from anywhere along the longitudinal length of the pushrod 218. That is, the first projection 222 and/or the wedge and/or bladed portion 224 may emanate from a sidewall of the pushrod 218 body proximate the top of the pushrod 218, proximate the middle of the pushrod 218, proximate the bottom of the pushrod 218, and/or along any point along the longitudinal axis of the pushrod 218 sidewall.

The elongate body 202 may have distinct portions. For example, the elongate body 202 may include a structurally compromised portion 226. The structurally compromised portion 226 may extend linearly along a longitudinal length of the elongate body 202. That is, the structurally compromised portion 226 of the elongate body 202 may include a portion of the elongate body 202 such as a strip that runs continuously from proximate a first end of the elongate body 202 to the second end of the elongate body 202.

The structurally compromised portion 226 may include a portion of the wall of the elongate body 202 that is engineered to have less structural integrity and/or resistance to cutting and/or shear forces than a remainder of the wall of the elongate body 202. For example, the structurally compromised portion 226 of the wall of the elongate body 202 may be a portion of the wall of the elongate body 202 with a thickness that is less than a thickness of a second portion of the wall of the elongate body 202. That is, the structurally compromised portion 226 of the elongate body 202 may include a portion of the elongate body 202 with relatively thinner walls than the remainder of the wall of the elongate body 202. The relatively thinner walls of the structurally compromised portion 226 may be relatively more prone or susceptible to (e.g., less force load required) cutting and/or shear forces than the thicker walled portions.

In some examples, the structurally compromised portion 226 of the wall of the elongate body 202 may be a portion of the wall of the elongate body 202 that is constructed of a different material than the remainder of the wall of the elongate body 202. That is, the structurally compromised portion 226 of the wall of the elongate body 202 may include a strip of the wall of the elongate body 202 that is made of a material with different characteristics or properties than the material from which the other portions of the wall of the elongate body 202 are constructed. Specifically, the structurally compromised portion 226 of the wall of the elongate body 202 may be made up of a material that is structurally strong enough to withstand the forces associated with filling, storing, transporting, and dispensing a dispensable substance from the dispensable substance container 200, but structurally weak and/or soft enough to be severed by the cutting and/or shear forces introduced by the wedge and/or blade portion 224 as described in further detail below.

In some examples, the structurally compromised portion 226 of the wall of the elongate body 202 may be a portion of the wall of the elongate body 202 that is structurally weakened. For example, the structurally compromised portion 226 of the wall of the elongate body 202 may be a portion of the wall of the elongate body 202 that is structurally weakened by perforating, scribing, scoring, abrading, etching, chemically modifying, heat treating, etc. such that the structurally compromised portion 226 of the wall of the elongate body 202 is relatively more prone or susceptible to (e.g., less force load required) cutting and/or shear forces than the other portions of the wall of the elongate body 202 that are not structurally weakened in the same manner. In an example, the elongate body 202 may be made of a pulp fiber cardboard and the structurally compromised portion 226 may include a perforated, scribed, abraded, etched, chemically modified, heat treated, etc. portion of the elongate body 202.

In some examples, the structurally compromised portion 226 of the elongate body 202 may extend to and/or through an attachment point between the elongate body 202 and the dispensing nozzle 206, For example, portions of the elongate body 202 and/or portions of the dispensing nozzle 206 that interact to form an attachment point may be structurally weakened and/or placed in alignment to the path of the structurally compromised portion 226 such that any projection traversing the path of the structurally compromised portion 226 may encounter, physically contact, and/or sever the attachment point.

Additionally, the wall of the elongate body 202 may have at least an inner layer and an outer layer. The inner layer of the wall of the elongate body 202 may be the layer of the wall of the elongate body 202 that is open to and/or contacts a dispensable substance within the cavity of the elongate body 202. The outer layer of the wall of the elongate body 202 may be the layer of the wall of the elongate body 202 that is opposite the inner layer and/or is open to environment.

In some examples, the inner layer and the outer layer of the wall of the elongate body 202 may be made up of and/or coated with materials with differing properties and/or characteristics. For example, the inner layer of the wall may be made up of or coated with a relatively softer and/or less structurally rigid material to provide a smooth interface across which to move the pushrod 218 and/or a sealing material. In an example, where the wall of the elongate body 202 is made up of a pulp fiber cardboard, the inner layer may be coated with a wax or other hydrophobic friction reducing leak barrier. Such a material relatively more prone or susceptible to (e.g., less force load required) cutting and/or shear forces than the material of the outer layer. The outer layer may provide more structurally rigidity but may be more resistant to cutting and/or shear forces. In such examples, the structurally compromised portion 226 of the wall of the elongate body 202 may be a portion of the outer wall of the elongate body 202 that is structurally weakened as described above. That is, since the inner layer is already relatively susceptible to cutting and/or shear forces, it may not be structurally weakened because the structurally weakening process may modify its characteristics or properties such that it is no longer sealing in the dispensable substance, providing a smooth and/or soft surface to facilitate the flow of the dispensable substance, and/or facilitating the movement of the sealing material and/or the pushrod 218 within the cavity of the elongate body 202. However, the structural integrity of the structurally compromised portion 226 may be effectuated by weakening the outer layer to produce a portion that is susceptible on the inner wall and the outer wall to cutting and/or shear forces.

The structurally compromised portion 226 of the elongate body 202 extending longitudinally along the length of the elongate body 202 may be a portion of the elongate body 202 that is to be severed. Likewise, the portion of the attachment point that is structurally compromised and/or situated in the path of the structurally compromised portion 226 of the elongate body 202 may be a portion of the attachment point that is to be severed.

That is, the elongate body 202 and/or attachment point may be engineered to be severed along and/or within its structurally compromised portion 226, hence the imposition of susceptibility to cutting and/or shear forces within the structurally compromised portion 226. Specifically, the elongate body 202 may be engineered to be severed along and/or within its structurally compromised portion 226 by the wedge and/or blade portion 224 of the first projection 222 emanating from the central body of the pushrod 218. Likewise, the attachment point be engineered to be severed along and/or within its structurally compromised portion 226 and/or along and/or within its portion that is aligned with the path of the structurally compromised portion 226.

For example, the leading and/or cutting edge of the wedge and/or blade portion 224 may be oriented straight down or at an angle toward the wall of the elongate body 202 and/or the attachment point. The leading and/or cutting edge of the wedge and/or blade portion 224 may be aligned with the structurally compromised portion 226 of the elongate body 202 and/or the attachment point. For example, the leading and/or cutting edge of the wedge and/or blade portion 224 may be aligned such that when the pushrod 218 is actuated into and/or through the cavity of the elongate body 202, the wedge and/or blade portion 224 may travel within and/or sever within a channel defined by the structurally compromised portion 226.

The pushrod 218 may travel along a stroke to dispense material from within the cavity of the elongate body 202. The stroke of the pushrod may occur between a first point, distal from the dispensing nozzle 206 and proximate a top opening into the cavity of the elongate body 202, and a second point, distal from the top opening into the cavity and proximate the dispensing nozzle 206, where the pushrod 218 has substantially bottomed out and/or traveled to its furthest point within the cavity before encountering the dispensing nozzle 206. For example, the pushrod 218, despite being shorter than the length of the cavity and/or the elongate body 202 may be advanced along the entirety of the cavity and/or the elongate body 202 during its stroke. This may be because the wedge and/or blade portion 224 protruding from the pushrod 218 may continue to sever the structurally compromised portion 226 of the elongate body 202 from one end of the elongate body 202 to the other during the stroke. The gap created between the severed portions of the elongate body 202 may accommodate the reminder of the of the first projection 222 emanating from the central body of the pushrod 218 which may move along with the pushrod 218, but through and outside of the elongate body 202. The reminder of the first projection 222 may provide a handle and/or shelf-like portion allowing a user to achieve and maintain a purchase on the first projection 222 while applying the force load to the pushrod 218 through the handle and/or shelf-like portion of the first projection 222 that may be utilized to move the pushrod 218.

Near the end and/or at the end of the stroke, the blade portion 224 protruding from the pushrod 218 may have traveled longitudinally along the entire length of the wall of the elongate body 202. As described above, during this travel the blade portion 224 may have severed the structurally compromised portion 226 of the elongate body 202 along its travel. The result of the pushrod's 218 completion of its stroke may be a discontinuous wall of the elongate body 202 with an opening into the cavity where the wall used to be joined at the structurally compromised portion 226. In some examples, the elongate body 202 may have been split into a plurality of separate portions and/or wall segments by the blade portion 224.

Additionally, near the end and/or at the end of the stroke, the blade portion 224 protruding from the pushrod 218 may sever the attachment point between the elongate body 202 and the dispensing nozzle 206. Once a disruption and/or discontinuity has been introduced to the attachment portion by the blade portion 224, the elongate body 202 may be freed from engagement with the dispensing nozzle, such that the elongate body 202 may be freely separable from the dispensing nozzle 206 and/or mating mechanism 220. As described above, the elongate body 202 may have been split into a plurality of separate portions and/or wall segments by the blade portion 224. Likewise, the attachment point may have been split into a plurality of separate portions and/or wall segments by the blade portion 224. Once the elongate body 202 and its attachment point has been severed by the complete stroke the portions of the wall of the elongate body may be freely separated from the dispensing nozzle 206 and/or mating mechanism 220 and placed into a recycling receptacle corresponding to the first material. Since the dispensing nozzle 206 and/or mating mechanism 220 were freed from engagement with the elongate body 202 when the attachment point was severed, the separated dispensing nozzle 206 may be placed into a recycling receptacle corresponding to the second material. Since the pushrod 218 was retained within the cavity during its stroke by the continuity of the wall of the elongate body 202 and the elongate body has, as a result of the stroke, been severed into a plurality of portions opening up the cavity and separating its walls, the pushrod 218 is also freely separable from the elongate body 202 and the dispensing nozzle 206. Accordingly, the pushrod 218 may be placed into a recycling receptacle corresponding to the third material.

However, it is contemplated that some examples of the present disclosure include dispensable substance containers that do not include a structurally compromised portion of the elongate body. That is, in some examples, the elongate body may be constructed of a uniform material with uniform characteristics and/or properties. For example, the elongate body may be a same material across its portions. A wall of the elongate body may be a same thickness across its portions. A wall of the elongate body may be subjected to the same treatments and/or processes across its portions. In such examples, the uniform material of the elongate body may be a material that is structurally strong and/or rigid enough to provide structural integrity to the dispensable substance container during filling, storing, transporting, and dispensing a dispensable substance from the dispensable substance container. Simultaneously, the uniform material of the elongate body may be a material that is soft enough to be severed by the wedge and/or blade portion of a first projection of a pushrod within particular force load threshold values. In these examples, advancing the pushrod through the cavity of an elongate body by applying a force load to the first projection causing the wedge and/or blade portion of the first portion of the pushrod to cut through the wall of the elongate body and/or the attachment point may operate in substantially the same way as described above. However, instead of selectively aligning the wedge and/or blade portion of a first projection of a pushrod with a structurally compromised portion of the elongate body and/or attachment point, any portion along the longitudinal length of the elongate body may be cut through.

In some examples, the structurally compromised portion 226 may include a portion of overlapping elongate body 202 walls. For example, at the structurally compromised portion 226 composite walls of the elongate body 202 may create an overlap localized within the structurally compromised portion 226. The overlap may establish and/or maintain a seal between the content within the elongate body 202 and the external environment. In such examples, the wedge and/or blade portion 224 of the pushrod 218 may or may not have a wedge or blade shape. For example, the wedge and/or blade portion 224 may have a dimension and/or a geometry, wedge shaped or not, that causes separation of the sealing overlap at the structurally compromised portion 226 as the pushrod 218 is advanced within the elongate body 202. The blade portion 224 may have any geometry, shape, form, etc. that, when the pushrod 218 is actuated, may provide a force load such as a shear force load against structurally compromised portion 226 that may cause separation of elongate body 202 walls into a plurality of portions at the structurally compromised portion 226. That is, the blade portion 224 may include a sharp angular projection, a rounded or blunt projection, and/or any other form of projection that may protrude far enough to and transfer enough force to cause separation of the elongate body 202 walls at the structurally compromised portion 226.

In some examples, the structurally compromised portion 226 may include a portion of the elongate body 202 walls that forms a clasp locking, zip fastener, zipper, etc. mechanism at and/or along the structurally compromised portion 226. For example, the structurally compromised portion 226 may include a portion of the elongate body 202 walls that form rows of protruding teeth able to be interdigitated to form a seal between the elongate body 202 walls that is able to be separated and/or joined by the movement of a slider and/or the blade portion 224 along the rows. In another example, the structurally compromised portion 226 may include a portion of the elongate body 202 walls that form opposing stems and clasps that are able to interlock with one another to form a seal between the elongate body 202 walls that is able to be separated and/or joined by the movement of the blade portion 224 along the rows.

For the purposes of this description, the structurally compromised portion 226 of the elongate body 202 may include any of the above examples including those where the structurally compromised portion 226 is structurally weakened, has relatively weaker structural characteristics than other portions the elongate body 202, and/or has similar or same structural characteristics of other portions of the elongate body 202 but is the channel where the elongate body 202 is cut.

In some examples, including examples where the structurally compromised portion 226 is structurally weakened and/or has relatively weaker structural characteristics than other portions the elongate body 202, the dispensable substance container 200 may include a sheath or guard portion. A sheath or guard portion may include a removable, rotatable, slide-able, etc. sheath or guard that covers at least the structurally compromised portion 226 of the elongate body 202, The sheath and/or guard portion may be fitted about and/or attached to the exterior of the elongate body 202 to cover at least the structurally compromised portion 226 prior to dispensing. The sheath and/or guard portion may provide structural reinforcement to at least the structurally compromised portion 226 of the elongate body 202. The sheath and/or guard portion may be removable and/or rotatable away from at least structurally compromised portion 226 and/or the channel where the wedge and/or blade portion 224 of the pushrod 218 will split the elongate body 202 immediately prior to dispensing. In this manner, the sheath and/or guard portion may reinforce and/or protect the structurally compromised portion 226 of the elongate body 202 from premature rupture, cutting, splitting, damage, etc., resulting from filling, storing, transporting, shipping, positioning, and/or handling the dispensable substance container 200.

Figure 3:
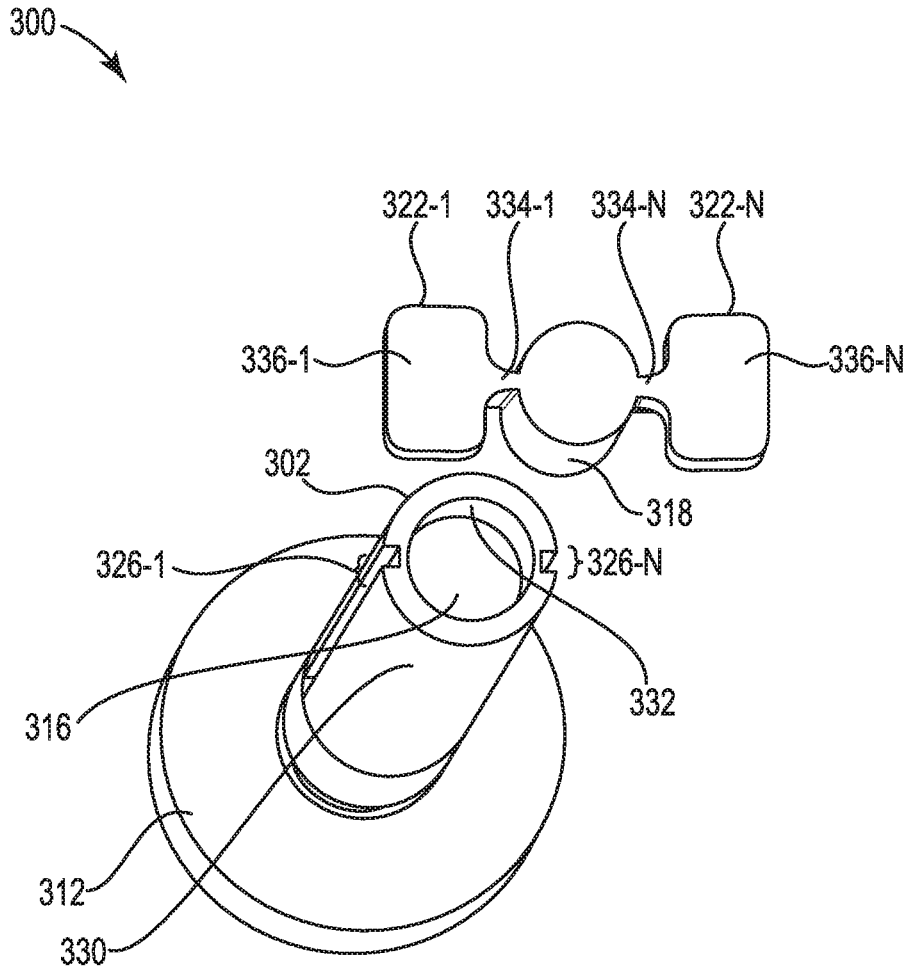
FIG. 3 illustrates a top view of a severable dispensable substance container according to the present disclosure.

FIG. 3 illustrates a top perspective view of a dispensable substance container 300 according to the present disclosure. The dispensable substance container 300 may include an elongate body 302. The elongate body 302 may include a wall that encompasses and defines a cavity within the elongate body 302, The wall of the elongate body 302 may be made of a first material. The wall of the elongate body 302 may have a width and/or thickness of material between an inner wall 332 and an outer wall 330 of the elongate body 302. The width and/or thickness of the wall of the elongate body may vary across portions of the elongate body 302.

The elongate body 302 may be attached to a dispensing nozzle. The dispensing nozzle (not visible in the illustrated orientation) may be made of a second material that may be separately recyclable from the first material. For example, the elongate body 302 may be attached to a dispensing nozzle at an attachment point longs its inner wall 332 and/or its outer wall 330.

The elongate body 302 may include structurally compromised portions 326-1, . . . 326-N. The structurally compromised portions 326-1 . . . 326-N of the elongate body 302 may have a different width and/or thickness than the non-structurally compromised portions of the elongate body 302. For example, the width and/or thickness of the wall of the elongate body 302 at the structurally compromised portions 326-1 . . . 326-N may be thinner and/or less wide than the wall of the elongate body 302 at the non-structurally compromised portions. In some examples, the structurally compromised portions 326-1 . . . 326-N may extend longitudinally along the elongate body 302 up to and/or through the attachment point.

The thinner structurally compromised portions 326-1 . . . 326-N may be portions of the wall of the elongate body 302 and/or the attachment point to be severed by a wedge and/or blade portion of each of a plurality of projections 322-1 . . . 322-N radially extending outward from the central body of the pushrod 318. The pushrod 318 and/or plurality of projections 322-1 . . . , 322-N may be made of a third material that may be separately recyclable from the first material and/or the second material. By aligning the wedge and/or blade portion of each of a plurality of projections 322-1 . . . 322-N, with the structurally compromised portions 326-1 . . . 326-N of the elongate body 302 and applying a force load to a handle portion of each of a plurality of projections 322-1 . . . 322-N the central body of the pushrod 318 may seat into the cavity of the elongate body 302 and advance through the cavity of the elongate body 302 as the wedge and/or blade portions sever the structurally compromised portions 326-1 . . . 326-N creating a gap in the wall of the elongate body 302 and/or the attachment point for the plurality of projections 322-1, . . . 322-N to span through and remain outside the cavity of the elongate body 302.

The pushrod 318 may contact and/or seat on top of a sealing material 316. Advancing the pushrod 318 may, in turn, advance the sealing material 316 and propel a dispensable substance within the cavity and under the sealing material 316 to be dispensed out of a dispensing nozzle into a dispensable substance receiving container 312. The pushrod 318 may be advanced by pressing on the plurality of projections 322-1 . . . 322-N. Each one of the plurality of projections 322-1 . . . 322-N may include a corresponding first portion 334-1 . . . 334-N and a corresponding second portion 336-1 . . . 336-N. The first portion 334-1 . . . 334-N may have a first width while the second portion 336-1 . . . 336-N may have a second width. Despite having differing widths, the first portion 334-1 . . . 334-N and the second portion 336-1 . . . 336-N may be continuous with each other and/or continuous with the central body of the pushrod 318. In some examples, the first portion 334-1 . . . 334-N may connect the second portion 336-1 . . . 336-N to the central body of the pushrod 318. In some examples, the width of the first portion 334-1 . . . 334-N may be less than the width of the second portion 336-1 . . . 336-N. As such, the first portion 334-1 . . . 334-N may be a portion having a width to fit within and a length to span through a gap created in the wall of the elongate body 302 by the blade mounted beneath the first portion 334-1 . . . 334-N. Further, the second portion 336-1 . . . 336-N may be a portion having a width and a length to be utilized as handles or pads upon which to apply a force load for advancing the pushrod 318.

Figure 4:
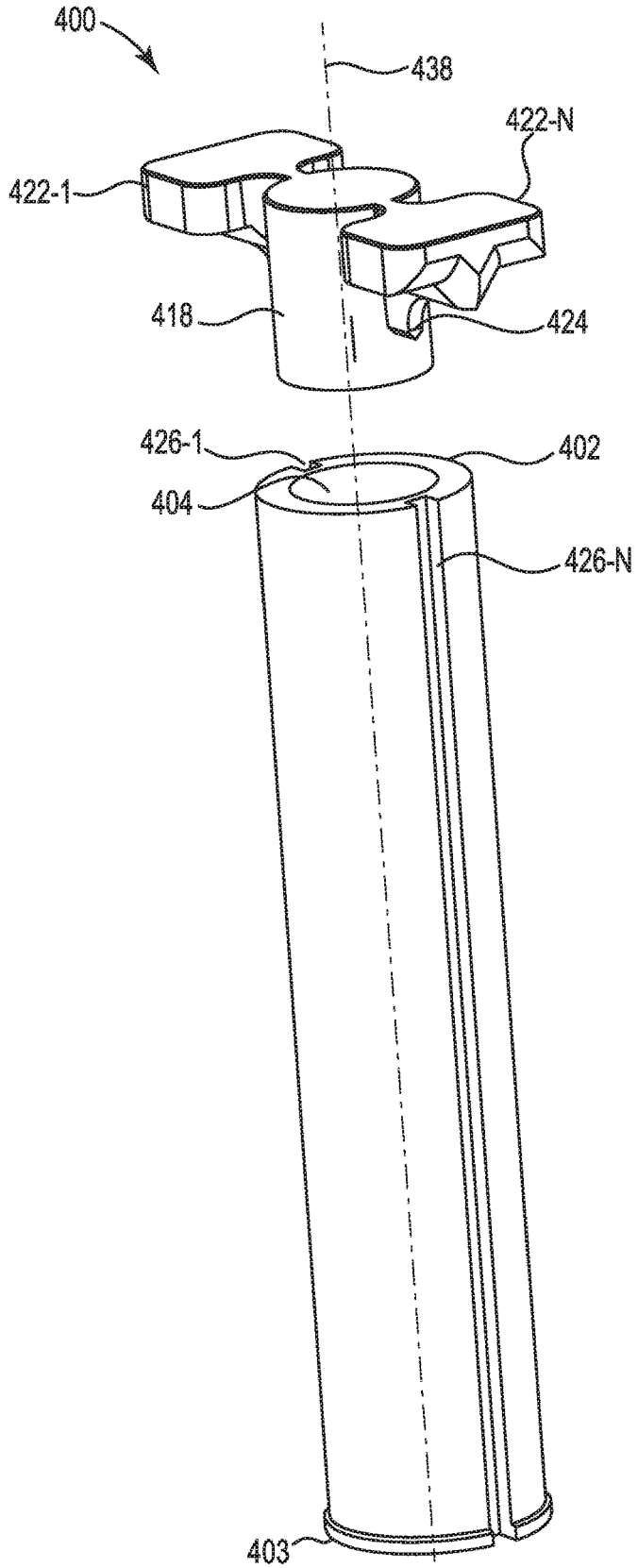
FIG. 4 illustrates a side view of a portion of a severable dispensable substance container.

FIG. 4 illustrates a perspective side view of a portion of a dispensable substance container 400. The dispensable substance container 400 may include an elongate body 402. The elongate body 402 may include a wall encompassing and defining a cavity 404 that may hold a dispensable substance. The elongate body 402 may include a portion of an attachment point 403. The portion of the attachment portion 403 may include a portion of the elongate body 402 dimensioned to engage with a complementary geometry of a dispensing nozzle in order to form an attachment point between the elongate body 402 and the dispensing nozzle such that the two are not separable prior to or during a dispensing stroke. The portion of the attachment point 403 may include a lip or other geometric structure on the exterior surface of the wall of the elongate body 402 to engage a complementary geometric structure such as a retention ledge on an interior surface of the wall of the dispensing nozzle. The elongate body 402 and/or the portion of the attachment point 403 may include structurally compromised portions 426-1 . . . 426-N.

A pushrod 418 may be utilized to advance the printable substance within a cavity 404 of the elongate body 402 through the cavity 404 and/or out of the elongate body 402. The central body of the pushrod 418 may include a cylindrically shaped rod dimensioned to seat snuggly but moveably within the cavity 404. However, the central body of the pushrod 418 may be any geometry that is a complementary geometry to the geometry of the cavity 404. However, a length of the pushrod along a longitudinal axis 438 may be less than a length of the cavity 404 and/or the elongate body 402 along the longitudinal axis 438.

However, a plurality of projections 422-1 . . . 422-N may emanate radially outward from the longitudinal axis 438 of the central body of the pushrod 418. The plurality of projections 422-1 . . . 422-N may extend from the central body of the pushrod 418 and outside of the wall of the elongate body 402 when the central body of the pushrod 418 is within the cavity 404 of the elongate body 402. That is, regardless how shallow or deep the pushrod 418 is seated into the cavity 404, the plurality of projections 422-1 . . . 422-N may stay outside of the central body of the pushrod 418.

Each of the plurality of projections 422-1 . . . 422-N may include a wedge and/or blade portion 424, although its geometry is not so limited. The wedge and/or blade portion 424 may include a portion that is contoured as to have a leading and/or cutting edge to concentrate and/or direct a shearing force. The wedge and/or blade portion 224 may be oriented such that the leading and/or cutting edge in pointed to the wall of the elongate body 402. The leading and/or cutting edge of the wedge and/or blade portion 224 may have a length that is at least as long as the wall of the elongate body 402 is wide, so that the leading and/or cutting edge of the wedge and/or blade portion 224 may cut through the entire width of the wall of the elongate body 402 in a single pass.

The pushrod 418 may be seated in the cavity 404 such that the leading and/or cutting edge of the wedge and/or blade portion 224 may be aligned with a corresponding structurally compromised portion 426-1 . . . 426-N of the elongate body 402. A user may exert a force load to the plurality of projections 422-1 . . . 411-N which may advance the central body of the pushrod 418 through the cavity 404 to dispense dispensable substances, all while the wedge and/or blade portion 224 extending from the central body of the pushrod 418 clears a path for the plurality of projections 422-1 . . . 411-N to pass through the wall of the elongate body 402 by severing the wall. As described above, the wedge and/or blade portion 224 extending from the central body of the pushrod 418 may also sever the portion of the attachment point 403.

Again, while some of the examples described herein are described in relation to severing structurally compromised portions 426-1 . . . 426-N of the elongate body 402 other examples are contemplated and described. For example, the examples may include an elongate body 402 made of a uniform material and/or having a uniform thickness that is strong enough to provide structural integrity during filling, storing, transporting, and dispensing a dispensable substance from the dispensable substance container, while simultaneously, being soft enough to be severed by the wedge and/or blade portion 424 under a force load within particular force load threshold values.

The pushrod 418 may be advanced through the cavity 404 of the elongate body 402 to expel a dispensable substance from an opposing end of the elongate body 402. For example, the pushrod 418 may be advanced through the cavity 404 of the elongate body 402 to expel a dispensable substance from a dispensing nozzle mated with a dispensable substance receiving container.

As described above, the pushrod 418 may travel along a stroke to expel the dispensable substance. The stroke may include the pushrod 418 advancing along the longitudinal axis 438 through and/or within the cavity 404 of the elongate body 402 from a first end of the elongate body 402, distal from the portion of the attachment point 403, to a second end of the elongate body 402, proximate the attachment point 403, During the stroke, the wedge and/or blade portion 224 extending from the central body of the pushrod 418 may sever the structurally compromised portions 426-1 . . . 426-N along the entire length of the elongate body 402 and/or through the portion of the attachment point 403. As such, at the end of the stroke, the elongate body 402 may be severed into a plurality of separable portions and the attachment between the elongate body 402 and the dispensing nozzle may be severed such that the plurality of portions of the elongate body 402 are freely separable from the dispensing nozzle. As the elongate body 402 is separate into a plurality of separable portions, the cavity 404 may be opened to the external environment releasing the pushrod 418 for separation from the elongated body 402 and the dispensing nozzle. As such, a completed stroke of the pushrod 418 may self-separate the dispensable substance container 400 into its constituent components pushrod 418, elongate body 402, and dispensing nozzle, so that the components may be separated for separate disposal and/or recycling.

FIGS. 5A-E illustrate a system 540 of dispensable substance containers according to examples of the present disclosure. FIGS. 5A-E may illustrate a progression through successive stages of dispensing a dispensable substance from a dispensable substance container 500.

The system 540 may include a dispensable substance container 600. The dispensable substance container 500 may include an elongate body 502. The elongate body 502 may include a wall encompassing a cavity. The cavity may contain a dispensable substance such as a printing substance. The wall of the elongate body 502 may be made of a first material. The first material may have a first set of mechanical, physical, chemical, and/or manufacturing properties. The first material may have a first prescribed method of disposal and/or recycling.

In some examples, the elongate body 502 may be made of a uniform material with a uniform thickness and/or a uniform treatment or preparation. In other examples, the elongate body 502 may include a structurally compromised portion 526. The structurally compromised portion 526 may extend longitudinally along a length of the elongate body 502.

The dispensable substance container 500 may include a dispensing nozzle 506 at a first end of the elongate body 502, The dispensing nozzle 506 may be made of a second material. The second material may have a second set of mechanical, physical, chemical, and/or manufacturing properties that are different than those of the first material. The second material may have a second prescribed method of disposal and/or recycling that is different than those of the first material.

The dispensing nozzle 506 may be attached to the elongate body 502 at the first end of the elongate body 502. For example, a portion of the dispensing nozzle 506 and/or a portion of the elongate body 502 may form an attachment point. In some examples, the attachment point may include a friction fit and/or an interlocking geometry fit between the portion of the dispensing nozzle 506 and/or a portion of the elongate body 502. In some examples, the attachment portion includes a lip on an exterior surface of the wall of the elongate body 502, opposite the cavity, to engage a retention ledge on an interior wall of the printing substance dispensing nozzle 506, In some examples, the structurally compromised portion 526 may include and/or extend through the attachment point. In some examples, the attachment point may be aligned in the path of the structurally compromised portion 526. The attachment point may retain and/or lock the dispensing nozzle 506 and the elongate body 502 together so long as it is intact. That is, the attachment point may fasten the dispensing nozzle 506 and the elongate body 502 together until it is destroyed. As such, the attachment point may fasten the dispensing nozzle 506 and the elongate body 502 together prior to and/or during dispensing of a printing substance from the cavity of the elongate body 502 out of the dispensing nozzle 506 into the dispensable substance receiving container 512.

The dispensable substance container may include a mating mechanism 520 including walls encompassing the dispensing nozzle 506 to mate with a dispensable substance receiving container 512 in an interlocking fashion to align the dispensing nozzle 506 into the dispensable substance receiving container 512. The dispensable substance receiving container 512 may be a printing substance reservoir cartridge of a printing device.

The mating mechanism 520 may be integrated with the dispensing nozzle 506. That is, the dispensing nozzle 506 and/or mating mechanism 520 may be formed and/or assembled as a single unitary piece or body. As such, the mating mechanisms 520 may be constructed of the same second material as the dispensing nozzle 506. However, in some examples, the mating mechanism 520 may be attached to the dispensing nozzle 506 at an attachment point between the two. For example, the mating mechanism 520 may be attached to the dispensing nozzle 506 via a friction fit and/or an interlocking geometry fit between the two. In such examples, the structurally compromised portion 526 may include and/or extend through the attachment point between the mating mechanism 520 and the dispensing nozzle 506. In such examples, the mating mechanism 520 may be constructed of a material that is different from the second material and/or the first material and/or has different prescribed methods of disposal and/or recycling than the first and second material.

The system 540 may include a pushrod 518. The pushrod 518 may be made of a third material. The third material may have a third set of mechanical, physical, chemical, and/or manufacturing properties that are different than those of the first material and/or the second material. The third material may have a third prescribed method of disposal and/or recycling that is different than those of the first and second materials.

The pushrod 518 may include a central body of the pushrod 518 that has a complementary geometry to the cavity formed by the elongate body 502. The central body of the pushrod 518 may be dimensioned to fit snuggly but moveably within the cavity of the elongate body 502.

The central body of the pushrod 518 may be moveable longitudinally along the length of the elongate body 502. That is, the central body of the pushrod 518 may be moveable from a second end of an elongate body 502 to an opposing first end of an elongate body 502 within the cavity of the elongate body 502. However, the central body of the pushrod 518 may have a length that is shorter than a length of the cavity and/or elongate body 502. Additionally, the pushrod 518 may be detachable and/or separable from the cavity and/or the elongate body 502.

A projection 522 may project radially outward from the central body of the pushrod 518. The projection 522 may extend from the central body of the pushrod 518 to outside the perimeter of the wall of the elongate body 502. For example, the projection 522 may extend outside of the cavity and outside the circumference of the walls of the elongate body 502.

A wedge and/or blade 524 may extend radially out from the central body of the pushrod 518 and/or extend downward from the projection 522. Again, as described above, the wedge shape is provided as an example geometry of blade 524, but it is contemplated that a blade 524 may have any geometry that may sever the elongate body. In some examples, the blade 524 may not have a traditional cutting or severing geometry but may function as a blade by virtue of having a higher shear strength than a shear strength of the wall and/or the structurally compromised 526 portion of the wall of the elongate body 502. The blade 524 may be aligned with a structurally compromised portion 526 of the elongate body 502 and/or the attachment point, in examples where the elongate body 502 includes such portions. The blade 524 may be positioned over the wall of the elongate body 502 with a leading and/or cutting edge positioned to slice into the elongate body 502.

The central body of the pushrod 518 may be advanced into the cavity of the elongate body 502 by pressing on the projection 522 once the elongate body 502 is mated with the dispensable substance receiving container 512. As the central body of the pushrod 518 in advanced deeper into and through the elongate body 502, the blade 524 may shear a gap 542 into the elongate body 502 and/or the attachment point. In some examples, the blade 524 may shear a gap 542 into the structurally compromised portion 526 of the elongate body 502 and/or the attachment point as the central body of the pushrod 518 is moved through the cavity along its stroke in response to a force load applied to a handle-like portion of the projection 522 outside of the wall of the elongate body 502. The handle-like portion of the projection 522 may remain connected to the central body of the pushrod 518 within the cavity through the gap 542 created by the shearing action of the blade 524.

Figure 5A:
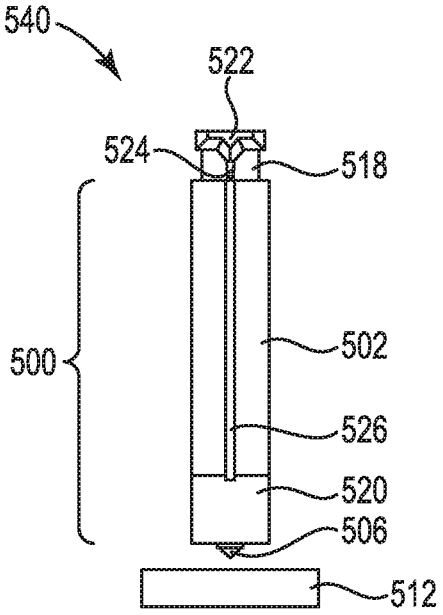
FIGS. 5A-E illustrate a system of severable dispensable substance containers according to examples of the present disclosure.
Figure 5B:
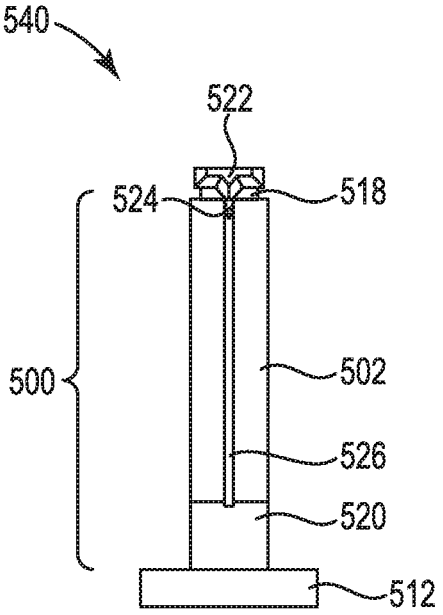
Figure 5C:
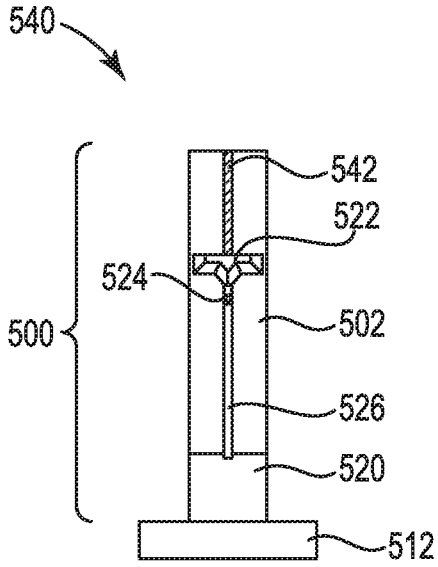
Figure 5D:
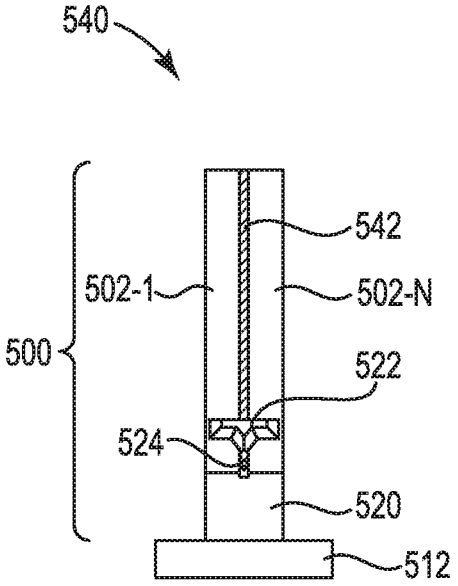
Figure 5E:
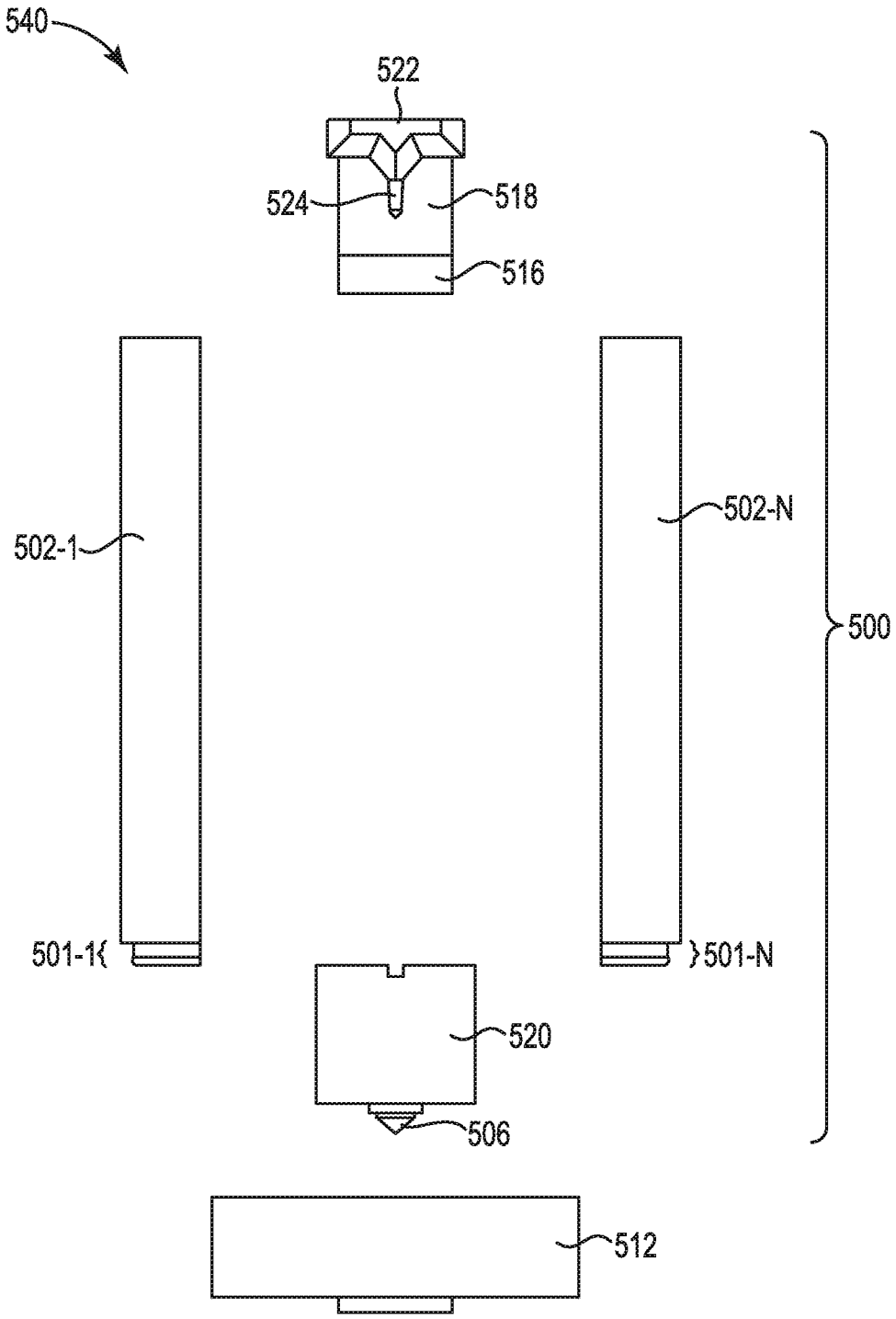

When the central body of the pushrod 518 has traversed the length of the cavity, the dispensable substance may be transferred out of the cavity of the elongate body 502 and transferred to a dispensable substance receiving container 512, completing the stroke of the pushrod 518. As such, the cavity of the elongate body 502 may be substantially emptied of the dispensable substance. As illustrated in FIG. 5D, at such a point when the stroke has been completed, the elongate body 502 may be split along its length into a plurality of portions 502-1 . . . 502-N, Although not fully visible from the illustrated perspective, the attachment point between the elongate body 502, or, more accurately the plurality of portions 502-1 . . . 502-N of the elongate body 502, and the dispensing nozzle 506 has been severed as well. Therefore, the friction fit or forces of the interlocking geometries have been dissipated and/or eliminated by the introduction of gaps through the attachment point. As such, the plurality of portions 502-1 . . . 502-N of the elongate body 502 and the dispensing nozzle 506 are freely separable once the stroke is completed.

As illustrated in 5E, upon completion of the stroke the dispensable substance container 500 may have been self-separated into its constituent components. For example, the blade 524 may have separated the elongate body 502 and/or the attachment point between the elongate body 502 and the dispensing nozzle 506 into a plurality of portions 502-1 . . . 502-N of the severed elongate body 502 and/or a plurality or portions 501-1 . . . 501-N of the severed attachment point. As such, the plurality of portions 502-1 . . . 502-N may be freely separable from the dispensing nozzle 506 without reverse assembly steps and/or without the application of force to pull-apart the dispensing nozzle 506 from the elongate body 502 in an amount to cause failure of the attachment point between the elongate body 502 and the dispensing nozzle 506. Instead, with the shearing of the attachment point into a plurality of portions 501-1 . . . 501-N by the blade 524, the stroke may have freed the separated plurality of portions 502-1 . . . 502-N of the severed elongate body 502 to be lifted away from the dispensing nozzle 506.

Additionally, upon completion of the stroke and separation of the plurality of portions 502-1 . . . 502-N of the severed elongate body 502, the cavity of the elongate body 502 is opened to the external environment releasing the pushrod 518 and/or any sealing material 516 positioned between the pushrod 518 and/or the dispensable substance within the cavity. As a result, the pushrod 518 and/or any sealing material 516 may be freely lifted away from the dispensing nozzle 506 and/or the separated plurality of portions 502-1 . . . 502-N of the severed elongate body 502. The sealing material 516 may also be freely peeled away from the pushrod 518.

Further, the dispensing nozzle 506 and/or the mating mechanism 520 may have been freed from their engagement with the pushrod 518, the sealing material 516, and/or the elongate body 502. Therefore, the dispensing nozzle 506 and/or the mating mechanism 520 may be detached from the dispensable substance receiving container 512, such as by reverse engagement, and lifted, separately from the pushrod 518, the sealing material 516, and/or the elongate body 502, away from the dispensable substance receiving container 512.

As such, the system 540 may include a dispensable substance container 500 that is consumable and/or non-reusable, as the functionality of its structures are destroyed during its use. While such a system 540 may drive further sales of a product utilizing such a system 540, appropriate disposal of the dispensable substance container 500 may reduce the harmful impact of the disposal of the consumable on the environment.

In contrast to systems that may utilize uniform materials through a container to allow for uniform disposal or recycling, the system 540 may utilize the diverse materials described above, which may allow for the use of the "best" material for each component. A "best" material for each component may include a material that has mechanical, physical, chemical, and/or manufacturing properties that are particularly suited to its function and/or the forces to which it will be subjected. Further, a "best" material for each component may include a material that is a cheapest material particularly suited to its function and/or the forces to which it will be subjected.

In contrast to mixed material devices that rely on complex, messy, and sometimes dangerous reverse assembly to separate mixed materials, the system 540 may self-separate the mixed materials into individual material types and/or disposal protocols by virtue of its use. That is, by utilizing the dispensable substance container 500 a user is presented with a collection of separated constituent components upon completion of its use. The user may then separately dispose of and/or recycle the constituent components based on their prescribed methods of disposal or recycling.

Examples described herein may include pushrod that has a length along a longitudinal axis that is less than a length of the cavity of an elongate body along the longitudinal axis. As a result, the packaging, storage, transportation, and shipping of such dispensable substance containers may be easier, cheaper, utilize less materials, and/or subject the dispensable substance containers to less potential damage in the processes. Further, as a result, the dispensable substance containers themselves may be simpler to manufacturer and/or include less material, potentially driving down the cost of manufacturing the dispensable substance containers. Furthermore, the dispensable substance containers may be fully consumable and/or non-reusable as a result of being severed into portions by the dispensing action. A non-reusable dispensable substance container may not only generate increased demand for a product by making it consumable but may also prevent unintended reuse by a user that may result in contamination of a dispensable substance. Contamination of a dispensable substance such as a printing material that may lead to the introduction of contaminants to a dispensable substance receiving container such as a printing substance reservoir. The contaminants may be introduced from the printing substance reservoir to a device such as a printing device, which may damage the printing device.

The devices and/or systems described herein are not intended to be limited to any specific example described herein. The components of specific examples of devices and/or the systems described herein may be interchangeable with components of other specific examples of devices and/or the systems described herein.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. For example, the reference numeral 102 may refer to element "02" in FIG. 1 and an analogous element may be identified by reference numeral 202 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense. Further, as used herein, "a" element and/or feature can refer to one or more of such elements and/or features.

What is claimed:

1. A dispensable printing substance container, comprising:
- a printing substance dispensing nozzle comprising a first material;
- an elongate body, comprising:
  - a wall, comprising a second material encompassing a cavity to contain a dispensable substance, and
  - an attachment portion to attach the elongate body to the printing substance dispensing nozzle; and
  - a structurally compromised portion of the elongate body extending along a length of the elongate body, wherein the elongate body and the attachment portion are to be severed along the structurally compromised portion by a pushrod moveable through the cavity to expel the dispensable substance out the dispensing nozzle.

2. The dispensable printing substance container of claim 1, wherein the first material and the second material are separately recyclable.

3. The dispensable printing substance container of claim 1, wherein the second material comprises a pulp fiber.

4. The dispensable printing substance container of claim 3, wherein a face of the elongate body facing into the cavity is coated with a barrier material.

5. The dispensable substance container of claim 1, wherein the structurally compromised portion of the elongate body is a structurally weakened portion of the wall of the elongate body.

6. The dispensable substance container of claim 1, wherein a non-structurally compromised portion of the elongate body has a greater shear strength than the structurally compromised portion of the elongate body.

7. A system, comprising:
- a dispensable printing substance container, including:
  - a printing substance dispensing nozzle comprising a first material;
  - an elongate body, comprising:
    - a wall, comprising a second material encompassing a cavity to contain a dispensable substance,
    - an attachment portion to attach the elongate body to the printing substance dispensing nozzle, and
    - a structurally compromised portion of the elongate body extending along a length of the elongate body and through the attachment portion of the elongate body, wherein the elongate body and the attachment portion are severable along the structurally compromised portion by a movement of a pushrod through the cavity; and
  - a pushrod, comprising a third material, moveable along the length of the elongate body through the cavity to expel the dispensable substance out the dispensing nozzle.

8. The system of claim 7, wherein the pushrod includes a projection off a central body of the pushrod, wherein the projection is extendable through the wall of the elongate body when the central body of the pushrod is seated within the cavity of the elongate body.

9. The system of claim 8, wherein the movement of the pushrod includes a stroke from a first end of the elongate body distal the attachment portion to a second end of the elongate body proximate the attachment portion.

10. The system of claim 9, wherein the projection includes a bladed portion position-able at the structurally compromised portion of the elongate body to split the elongate body, including the attachment portion, into a plurality of segments along the structurally compromised portion, releasing the attachment between the elongate body and the printing substance dispensing nozzle, during the stroke.

11. The system of claim 10, wherein each of the plurality of segments of the split elongate body are separable from the printing substance dispensing nozzle to release the pushrod from the cavity.

12. A device, comprising:

a printing substance dispensing nozzle;

an elongate body comprising:

a wall encompassing a cavity to contain a dispensable printing substance, an attachment portion to attach the elongate body to the printing substance dispensing nozzle;

a structurally compromised portion of the wall extending longitudinally along a length of the elongate body; and a pushrod, including:

a central body of the pushrod, to seat within the cavity, moveable longitudinally through the length of the elongate body to expel the dispensable printing substance out the printing substance dispensing nozzle, and a projection from the central body to separate the elongate body, the pushrod, and the printing substance dispensing nozzle by introducing a gap into the structurally compromised portion of the wall and the attachment portion when the central body is moved through the cavity in response to a force applied to a handle outside of the wall and connected to the central body through the gap.

13. The device of claim 12, wherein the elongate body is split into a plurality of portions when the central body is pushed to a first end of the elongate body and the dispensable printing substance is transferred out of the cavity.

14. The device of claim 12, wherein the attachment portion is split into a plurality of portions releasing the attachment between the elongate body and the printing substance dispensing nozzle when the central body is pushed to a first end of the elongate body and the dispensable printing substance is transferred out of the cavity.

15. The device of claim 12, wherein the attachment portion comprises a lip on an exterior surface of the wall, opposite the cavity, to engage a retention ledge on an interior wall of the printing substance dispensing nozzle.

* * * * *